US007188984B2

(12) United States Patent
Sayers et al.

(10) Patent No.: US 7,188,984 B2
(45) Date of Patent: Mar. 13, 2007

(54) LED HEADLAMP ARRAY

(75) Inventors: Edwin Mitchell Sayers, Saline, MI (US); Jeffrey Erion, Plymouth, MI (US); Rainer Neumann, Denmark (DE); Jeyachandrabose Chinniah, Ann Arbor, MI (US); Leonard Livschitz, West Bloomfield, MI (US); Scott West, Livonia, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 158 days.

(21) Appl. No.: 10/418,955

(22) Filed: Apr. 17, 2003
(Under 37 CFR 1.47)

(65) Prior Publication Data

US 2004/0208018 A1 Oct. 21, 2004

(51) Int. Cl.
*F21S 8/10* (2006.01)

(52) U.S. Cl. ..... 362/545; 362/518; 362/240; 362/297; 362/331; 362/346

(58) Field of Classification Search ..... 362/545, 362/518, 522, 240, 244, 245, 241, 297, 331, 362/332, 346
See application file for complete search history.

(56) References Cited

U.S. PATENT DOCUMENTS 3,805,049 A * 4/1974 Frank et al. ..... 40/444
5,361,190 A * 11/1994 Roberts et al. ..... 362/464
5,438,487 A 8/1995 Schmid et al.
5,477,436 A 12/1995 Bertling et al.
5,490,049 A 2/1996 Montalan et al.
5,515,253 A * 5/1996 Sjobom ..... 362/244
5,632,551 A 5/1997 Roney et al.
5,765,940 A 6/1998 Levy et al.
5,803,579 A 9/1998 Turnbull et al.
5,894,195 A 4/1999 McDermott
6,010,233 A * 1/2000 Mulder et al. ..... 362/297
6,053,623 A * 4/2000 Jones et al. ..... 362/310
6,132,072 A 10/2000 Turnbull et al.
6,206,549 B1 3/2001 Li
6,252,724 B1 6/2001 Scheer
6,299,337 B1 10/2001 Bachl et al.
6,328,456 B1 12/2001 Mize
6,328,463 B1 12/2001 Okubo
6,367,949 B1 4/2002 Pederson
6,367,950 B1 4/2002 Yamada et al.
6,412,971 B1 * 7/2002 Wojnarowski et al. ..... 362/249
6,414,743 B1 * 7/2002 Nishi et al. ..... 355/69
6,414,801 B1 7/2002 Roller
6,637,914 B2 * 10/2003 Naganawa ..... 362/465
6,728,393 B2 * 4/2004 Stam et al. ..... 382/104
2002/0118548 A1 8/2002 Kuenstler et al.

FOREIGN PATENT DOCUMENTS

EP 0 942 225 A2 3/1990
EP 1 010 578 A2 12/1999

* cited by examiner

*Primary Examiner*—John Anthony Ward
*Assistant Examiner*—Mark Tsidulko
(74) *Attorney, Agent, or Firm*—Brinks Hofer Gilson & Lione

(57) ABSTRACT

An LED headlamp array having discrete LED light source modules, where each light source module has an LED light source, optics dedicated to each LED light source, and a faceted reflector.

21 Claims, 9 Drawing Sheets
(2 of 9 Drawing Sheet(s) Filed in Color)

LED HEADLAMP ARRAY

The present invention relates to a headlamp, and more particularly to an automotive headlamp using an LED light source array.

BACKGROUND

A modern vehicle headlamp assembly commonly includes sealed electrical connectors, sophisticated injection-molded lenses and molded, metal-coated reflectors which work in concert to collimate and distribute white light from an incandescent, halogen, or arc-discharge source (HID).

Many modern electric light sources are relatively inefficient, e.g., conventional tungsten incandescent lamps, or require high voltages to operate, e.g., fluorescent and arc-discharge lamps, and, therefore are not optimal for vehicular head lamp light sources where only limited power is available, only low voltage is available or where high voltage is unacceptable for safety reasons. Most conventional white-light headlamps rely upon incandescent, halogen or HID lamps as light sources. However, these lamps possess a number of shortcomings that must be taken into account when designing a headlamp assembly.

Incandescent lamps are fragile and have a short life even in stable environments and consequently must be replaced frequently at great inconvenience, hazard, and/or expense. In addition to their inherently short life, incandescent lamps are very susceptible to damage from mechanical shock and vibration. Automobiles experience severe shocks and significant vibration during driving conditions that can cause damage to incandescent lamps, particularly the filaments from which their light emissions originate.

Incandescent lights also exhibit certain electrical characteristics that make them inherently difficult to incorporate in vehicles, such as an automobile. For instance, when an incandescent light source is first energized by a voltage source, there is an initial surge of current that flows into the filament. This in-rush current, which is typically 12 to 20 times the normal operating current, limits the lifetime of the lamp, thus further amplifying the need for frequent replacement. Incandescent lamps also suffer from poor efficiency in converting electrical power into radiated visible white light. Most of the electrical energy they consume is wasted in the form of heat energy while less than 7% of the energy they consume is typically radiated as visible light.

Another problem associated with incandescent, halogen, and HID lamps is that they generate large amounts of heat for an equivalent amount of generated light. This results in very high bulb-wall temperatures and large heat accumulations which must be dissipated properly by radiation, convection, or conduction to prevent damage or destruction to the illuminator support members, enclosure, optics or to other nearby vehicle components. This high heat signature of common light sources in automotive headlamps has a particularly notable impact on the specialized reflector and lens designs and materials used to collimate and direct the light. Design efforts to dissipate the heat while retaining optical effectiveness further add requirements for space and weight to the illuminator assembly, a severe disadvantage for vehicular applications that are inherently sensitive to weight and space requirements.

Moreover, the illuminance of an incandescent light source depreciates over time. It is very common for a filament type light source used in headlamp applications to loose more than 25% of its output when compared to the initial output of the bulb. Very long life halogen bulbs may loose up to 50% of their output over their useful life.

HID lamps provide more light than that produced by halogen lamps and incandescent bulbs, and use less power than halogen, and thus, are more efficient. Moreover, since there is no filament to burn out, these bulbs are claimed to last for as much as 100,000 miles of driving time. However, although HID's last longer than halogen and incandescent light sources, they are very expensive and require the use of ballast. Moreover, a common complaint with HIDs is that they produce an excessive amount of glare. HID light sources (bulbs) typically have about two to three times the available light flux (volume) of halogen light sources and the HID beam pattern is more robust than that of halogen sources, providing more even and wider illumination and the potential for better visibility and comfort. This results in more light on the road surface and more of the roadway being illuminated. However, this additional light is not supposed to be projected upward from the lamp toward oncoming drivers' eyes. During inclement weather, when the road surface is wet, the additional volume of light can result in higher levels of light reflected off the road surface into other drivers' eyes.

More recently, great interest has been shown in the use of semi-conductor devices such as light emitting diodes (LEDs) as the light source for illuminator systems. Due to their strong coloration and relatively low luminous output as compared to incandescent lamps, early generations of LEDs found most of their utility as display devices, e.g., on/off and matrix-addressed indicators, etc. These uses still dominate the LED market today, however recent advances in LED materials, design and manufacturing have resulted in significant increases in LED luminous efficacy and, in their most recent commercial forms, exhibit a higher luminous efficacy than incandescent lights.

LEDs offer other many potential advantages as compared to other conventional low voltage light sources for vehicles. LEDs are highly shock resistant and therefore provide significant advantages over incandescent and fluorescent bulbs that can shatter when subjected to mechanical or thermal shock. LEDs possess operating lifetimes from 200,000 hours to 1,000,000 hours, as compared to the typical 1,000 to 2,000 hours for incandescent lamps, 1000 hours for halogen, and 5,000–10,000 hours for fluorescent bulbs. The heat generated by LED light sources is also significantly less than that generated by conventional vehicular headlamp light sources that use filaments. Since relatively little heat is generated by LED light sources, the volume inside the headlamp can be minimized, thereby minimizing package depth of the headlamp. Also, LED light sources have a very low level of light output degradation over time, i.e., less than ten percent over the life of the vehicle versus about twenty five percent of the life of the vehicle with conventional light sources.

Moreover, since conventional light sources generally utilize a single bulb or light source, headlamp design is generally limited. Use of an array of LED light source modules permit a range of possible headlamp design configurations. In addition, for customers who desire greater light output performance from the headlamp, more LED light source modules can be added. A further advantage of the use of an array of LED light source modules is the adjustability and adaptability of the headlamps utilizing such modules. By switching on or off certain LED modules within the headlamp, the beam pattern from the headlamp can be altered to meet road conditions or vehicle actions. For example, if some of the modules of the array are arranged to the right, when the vehicle enters a right turn, these modules can be selectively adjusted, either by switching them on or increasing their light output, to permit the driver of the vehicle greater visibility of the road and area into the right turn. Likewise, LED modules aimed to the left can be dimmed so as to minimize distraction to the driver. In addition, with an array of LED light source modules, failure of one or a couple of modules results only in a slight loss of light output as opposed to complete loss of light output resulting from the failure of conventional bulbs.

Finally, with LED headlamp arrays various individual lenses of the same or varying types can be associated with each individual LED to create different beam patterns and optimize those beam patterns depending on the desired use.

Thus, it is desirable to replace conventional bulbs with arrays of white light emitting diode light sources in headlamps used on vehicles. The present invention solves the above-identified problems associated with the use of conventional bulbs in vehicular headlamps.

SUMMARY

The scope of the invention is determined solely by the appended claims and their equivalents and is not affected to any degree by the statements within this summary.

The present invention is directed to a vehicular headlamp assembly including an array of light emitting diode (LED) light source modules, each having dedicated optics. Specifically, the headlamp assembly of the present invention includes an array of LED light source modules in which each module includes its own LED light source, its own lens capable of both refracting and reflecting light from the light source, and its own reflector having a contoured inner reflective surface. In one embodiment, modules dedicated to a specific function, such as high beam or low beam function, are in electrical communication with a circuit board for control of that function. In another embodiment, each individual light source is selectively controlled. This can be accomplished by communication with the control module or through communication with vehicle electronics.

BRIEF DESCRIPTION OF SEVERAL VIEWS OF THE DRAWINGS

The file of this patent contains at least one drawing executed in color. Copies of this patent with color drawings will be provided by the Patent and Trademark Office upon request and payment of the necessary fee.

DETAILED DESCRIPTION

The present invention is directed to a vehicular headlamp assembly including an array of light emitting diode light source modules each having dedicated optics.

Figure 1:
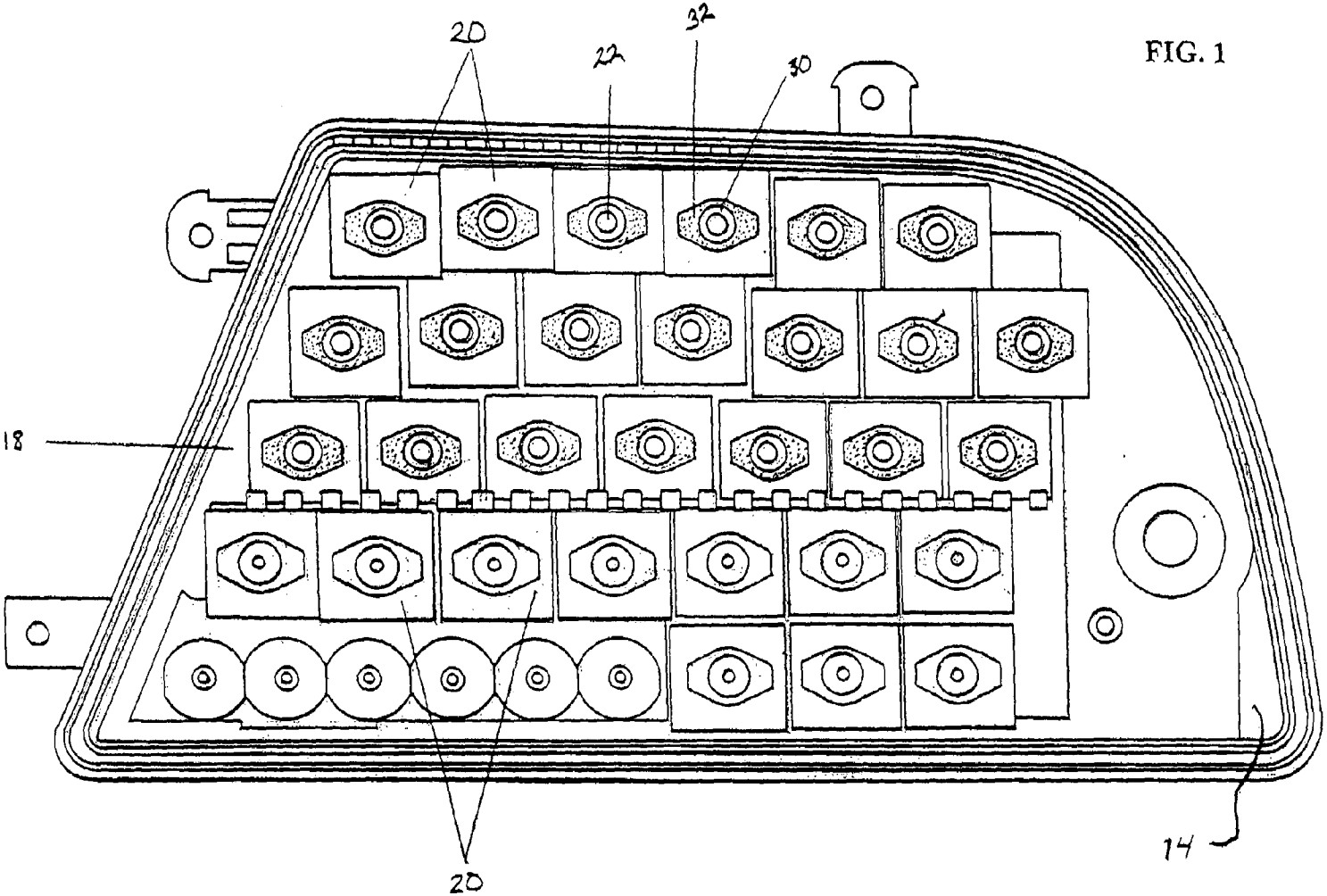
FIG. 1 illustrates a frontal view of a headlamp with an embodiment of the LED light source array according to the present invention.
Figure 2:
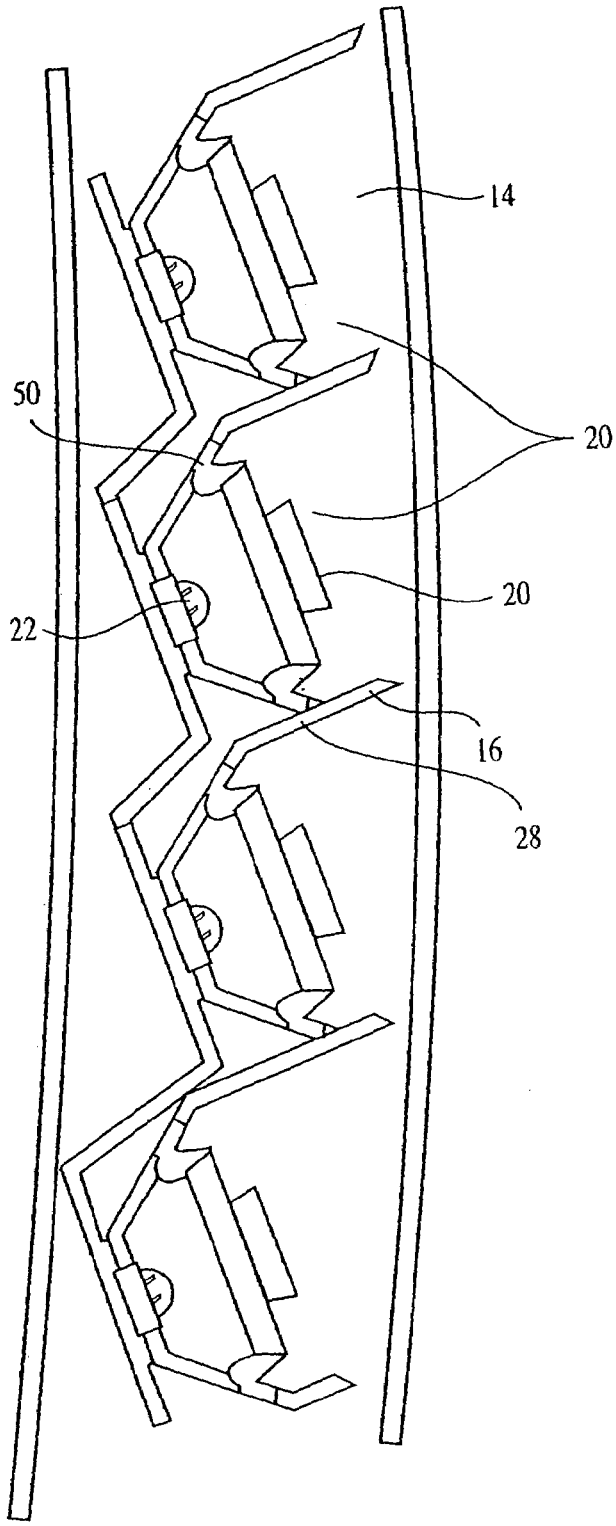
FIG. 2 illustrates a partial section view of a headlamp with an embodiment of the LED light source array according to the present invention.

As shown in FIG. 1, and in partial cross-section in FIG. 2, headlamp 10 includes housing 12 having a front opening 14 and outer lens 16 attached to housing 12 and covering front opening 14. Housing 12 may by square, rectangular, oval, round, oblong, or any other configuration desired, as illustrated in FIGS. 7A–7D. Housing 12 may be formed of any suitable material including, but not limited to, plastic, fiberglass, metal, and combinations thereof.

Outer lens 16 may be adhered to housing 12 by any means known to one skilled in the art, such mechanical or adhesive means including, but not limited to, screws, bolts, adhesives, ultrasonic welding, tab in groove, and the like. Outer lens 16 may be permanently or removably attached to housing 12 depending on whether access to the interior of the housing is desired through front opening 14, and may be attached by any means known to one skilled in the art. Outer lens 16 may or may not include faceting or other light distribution means. In a preferred embodiment, outer lens 16 does not include faceting or light distribution means.

An array 18 of LED light source modules 20, as shown in FIG. 1, are arranged in an array 18 of vertical columns and/or rows within housing 12. Array 18 includes a plurality of individual white light emitting diode light source modules 20 having dedicated optics. As shown in FIGS. 3–6, modules 20 each comprise an LED light source 22, module lens 26, and reflector 28. Modules 20 are arranged in vertical columns, horizontal rows, or combinations thereof, depending upon the desired headlight configuration, for example as those shown in FIGS. 7A–B. Light source 22 may be in electrical communication with a control module, such as a circuit board, or other memory device, that may be located with the headlamp or separate from the lamp, or may be integrated with other vehicle electronics, dedicated to light source 22

Figure 3:
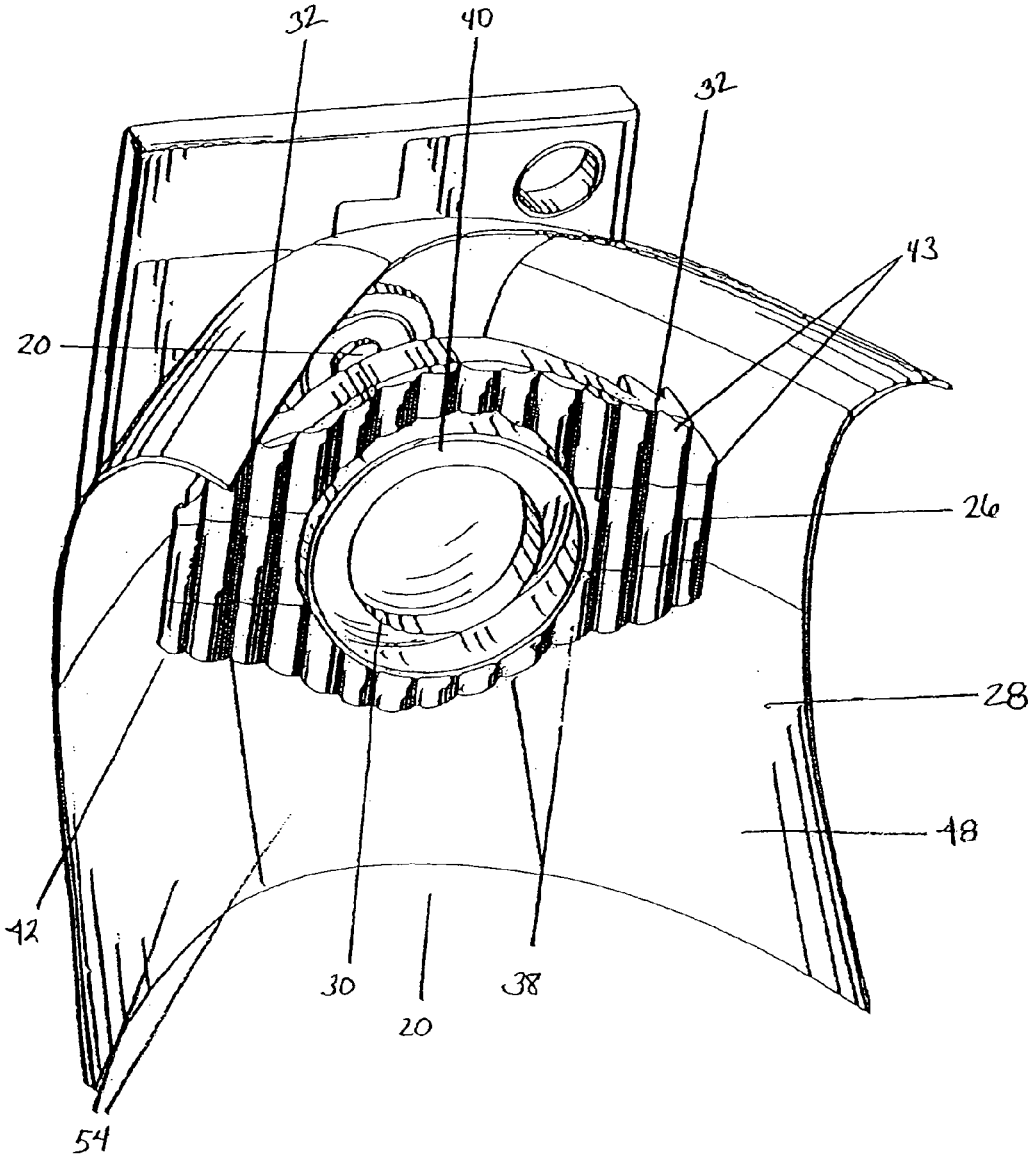
FIG. 3 is a perspective view an LED light source module according to one embodiment of the present invention.
Figure 4:
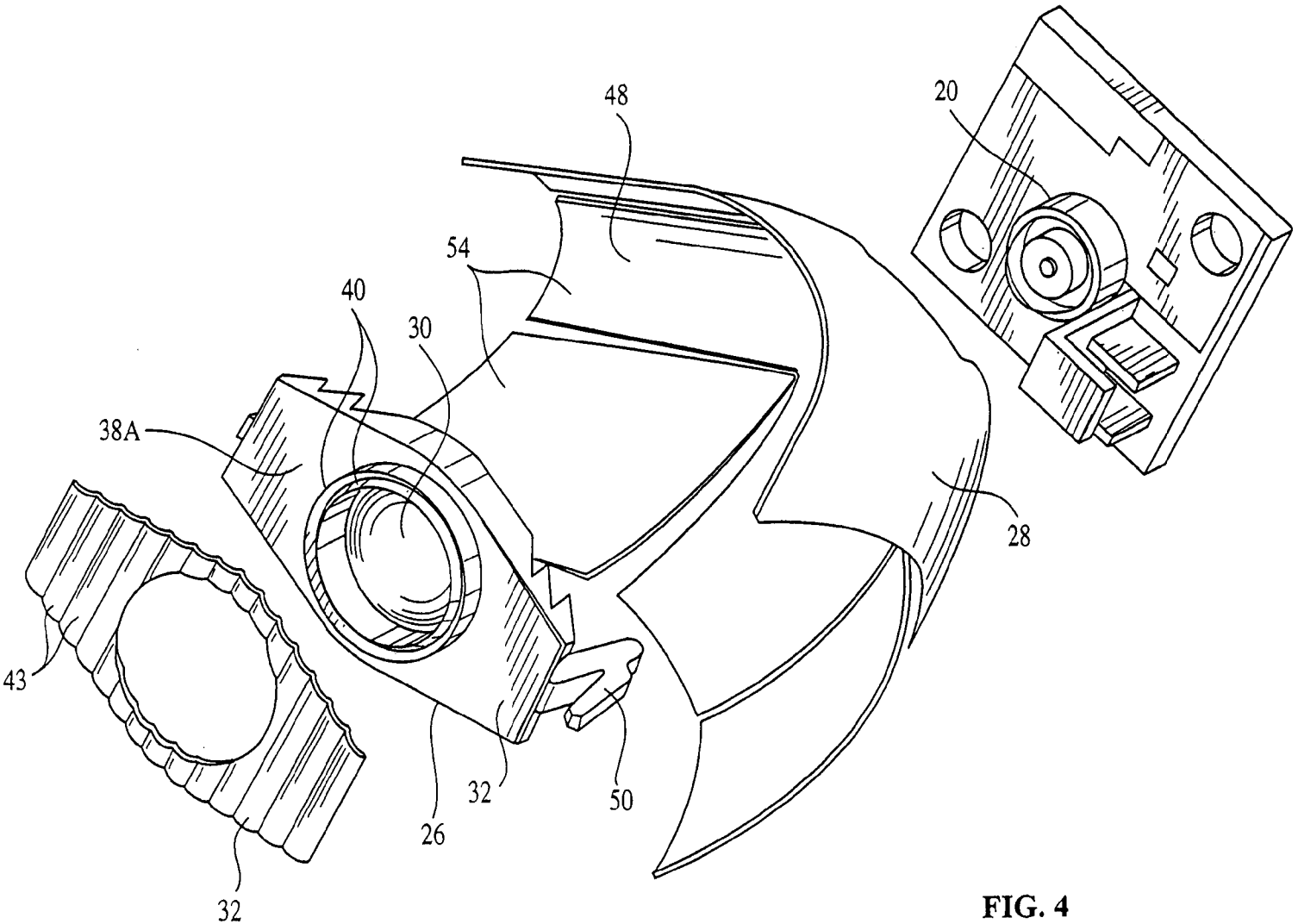
FIG. 4 is an exploded perspective view of an LED light source module according to one embodiment of the present invention.
Figure 5:
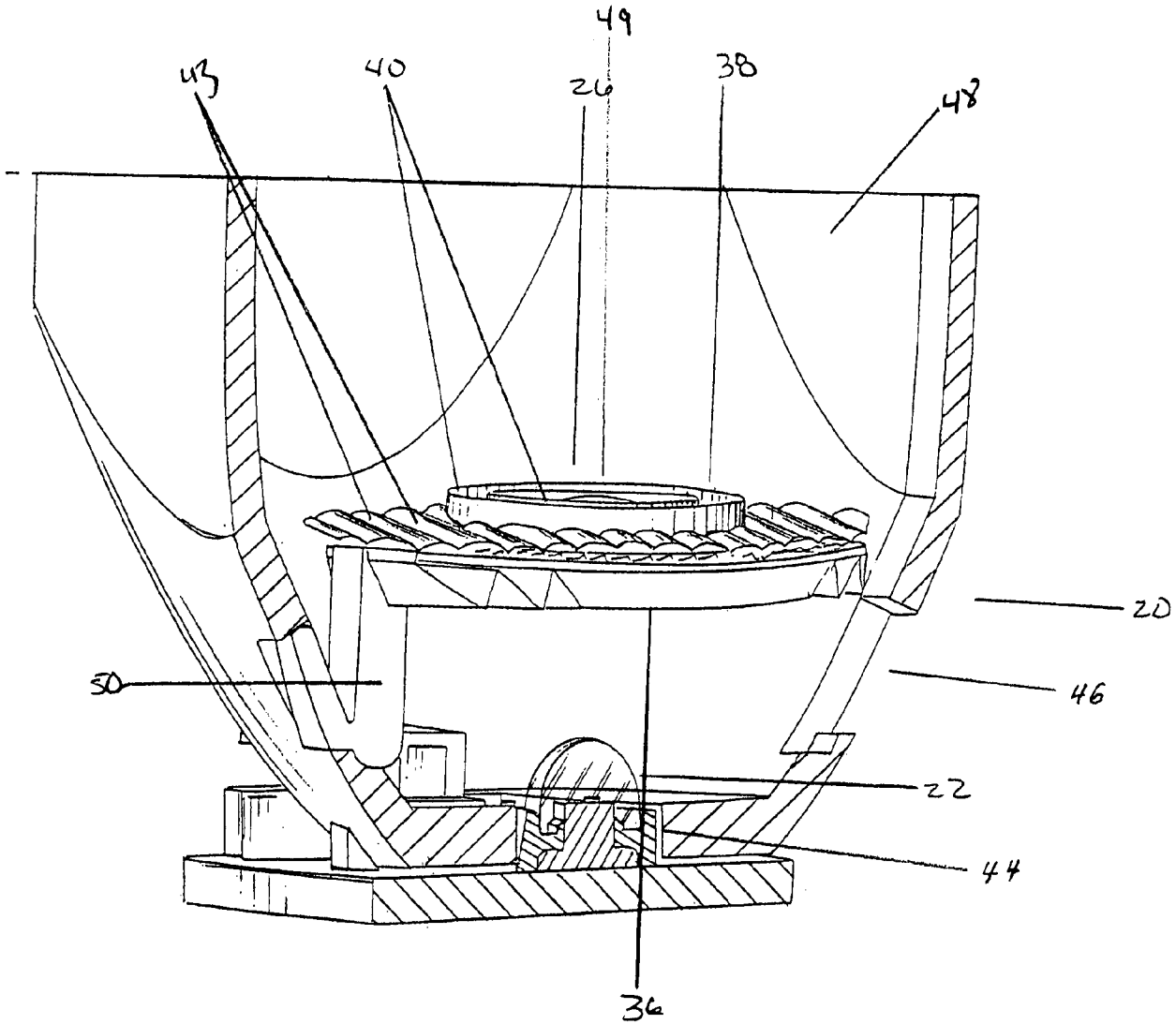
FIG. 5 is cross-sectional side view of an LED light source module according to one embodiment of the present invention.

Module lens 26 may be generally and approximately elliptical or obround, as shown in FIG. 3, or parabolic in nature, and comprises a prescribed free-form surface, with central region 30 and ears 32 extending from central region 30. Preferably, module lens 26 is catadioptric. A lens that is catadioptric has the capacity to both reflect and refract light. As shown in FIG. 5, module lens 26 has an inner LED light source-facing or photon-receiving surface 36 and an outer or photon-emitting surface 38. Preferably, both surfaces of module lens 26 comprise optical surfaces. As shown in one embodiment according to the present invention at FIGS. 4–6, both inner surface 36 and outer surface 38 of lens 26 are radial microprism structures such as those on a Fresnel type lens. Inner surface 36 and outer surface 38 reflect and refract light collected from LED light source 22 into parallel beams. In one embodiment, shown in FIGS. 3–5, the optics of outer surface 38 comprise annular rings 40 in central region 30 of lens 26 and refractive optics 42, shown as parallel lens ribs 43 in FIG. 3, extending into ears 32 of lens 26. Lens ribs 43 preferably form a convex arc or bow shape on outer surface 38 of ears 32. This embodiment is generally constructed for use as the low-beam or dim option of headlamp 10 in which greater diffusion or spreading of the intensity of light emitted from LED light source 22 is desired. Refractive optics 42 may include pillows or flutes or any other configuration known to one skilled in the art to perform the refraction function. In another embodiment, as shown in FIG. 4, ears 32 of outer surface 38A of lens 26 is smooth. This embodiment is generally constructed for use as the high-beam or bright option of headlamp 10 in which brighter and/or more direct light from the LED light source 22 is desired. In the high-beam embodiment, lens 26 collects light emitted from LED light source 22 and directs the collimated beam axially outward from light source 22.

Light sources 22 may be operatively connected, either directly or indirectly, and in electrical communication with an electrical current control device with an optional logic control element. In one embodiment, array 18 may be in electrical communication with a logic control element, such as a control circuit board or microchip, that controls the functioning of the LED light source modules 20 of array 18. In another embodiment, each LED light source module 20 having a particular function, i.e. high beam or low beam, is associated with a control element having a logic control element dedicated to that function. In yet another embodiment, each individual LED light source module 20 is associated with its own logic control element for dedicated, individual control of light source module 20. In this way, each module 20 may be selectively and individually controlled so as to provide desirable amounts and patterns of light emitted from headlamp 10. In this way, modules in a single array may be selectively and differently operated and illuminated to achieve different lighting requirements. For example, to reduce or prevent glare to the vehicle driver, LED lights sources located in the driver's side headlamp may be selectively reduced in intensity or completely turned off. In another example, rather than having only two illumination intensities, as is common in most vehicle headlamps, a variety of intensities for varying driving conditions may be achieved.

Figure 6:
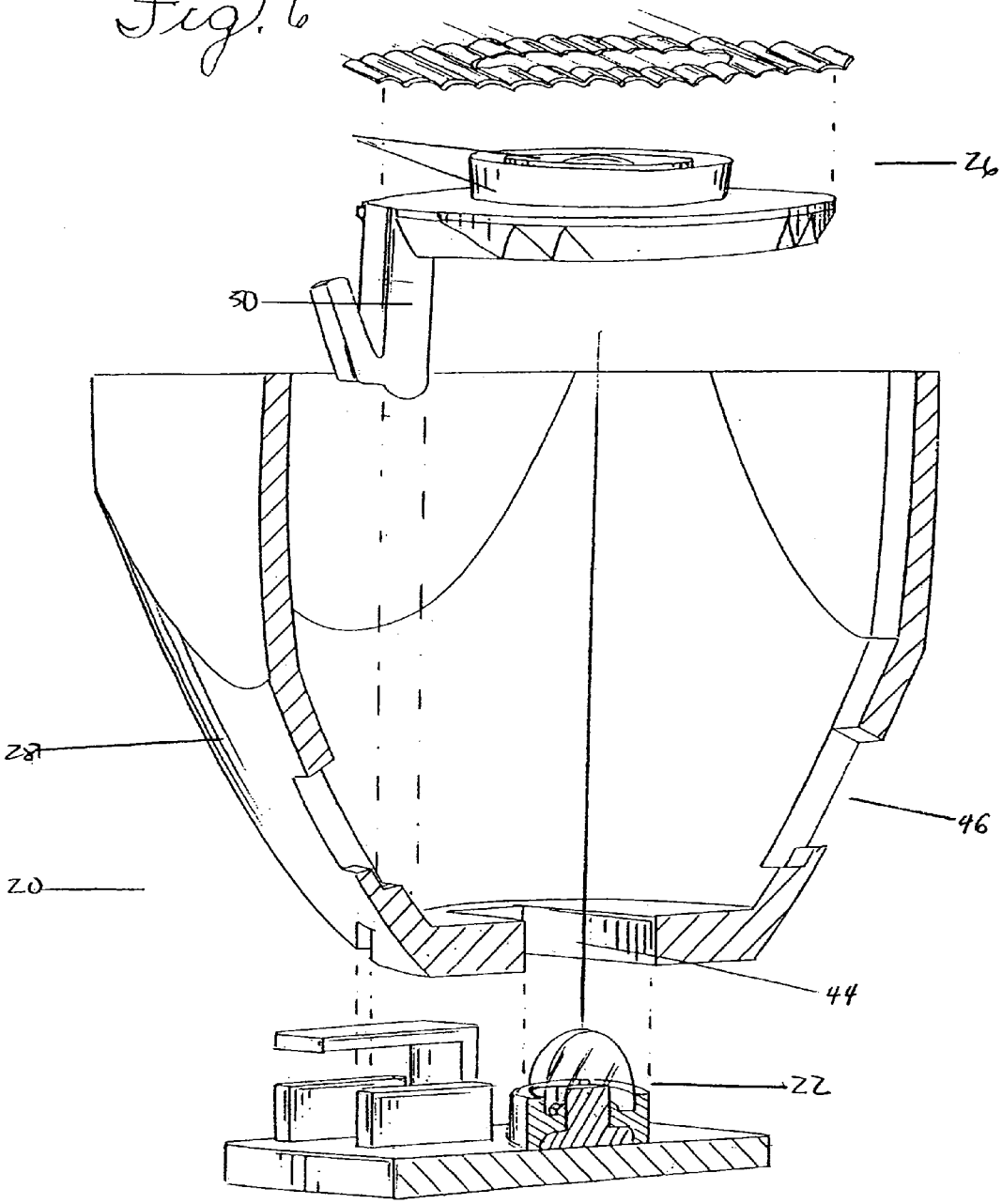
FIG. 6 is an exploded side view of an LED light source module according to one embodiment of the present invention.

Preferably, LED light source 22 is disposed within reflector 28, as shown FIGS. 3 and 4. Referring to FIGS. 5 and 6, reflector 28 comprises a first opening 44, a second opening 46, and a reflective inner surface 48. First opening 44 is adapted to receive LED light source module 22. Lens 26 may be disposed within reflector 28 and held and supported in reflector 24 by support members 50. It is also contemplated that lens 26 may be positioned in a range of positions with respect to the reflector, such at the edge of or beyond the edge of the reflector or adjacent to/adjoining the reflector. Preferably, lens 26 is disposed within and connected to reflector 28. Lens 26 may be connected to reflector by any means known to one of skill in the art.

Preferably, the perimeter of lens 26 approximately conforms to the inner contour of reflective surface 48 of reflector 28 as seen from the focal point 49 of the LED light source 22. As shown in FIGS. 4, 5 and 6, support members 50 are snap-in fittings. Support members are preferably made of plastic or other flexible, electrically insulating material and are snap fitted into reflector 28. Other attachment members may be incorporated to insure proper dimensional relationship between the related optical components.

Reflector 28 comprises a cup-shaped body having a generally parabolic internal reflecting surface 48, although other shapes, such ellipses, hyperbolas, hemispheres and cones are also contemplated. Reflecting surface 48 reflects light emitted from LED light source 22 that is not collected and distributed by lens 26. Preferably, reflector 28 is an axial reflector lens in which reflector 28 may be oriented in substantial registry with LED light source 22. Reflecting surface 48 preferably comprises at least two contiguous reflecting surfaces. More preferably, reflecting surface 48 comprises at least four and preferably six radially aligned contiguous reflecting surfaces. In the most preferred embodiment, reflecting surface 48 comprises eight contiguous facets 54 as shown in FIGS. 3 and 4. Facets 54 may be square, rectangular or trapezoidal. Although facets 54 may be of differing sizes and shape, preferably, facets 54 are approximately identical in shape and size. In one embodiment, facets 54 may have a curved reflecting surface, as shown in FIGS. 3 and 4.

Figure 8:
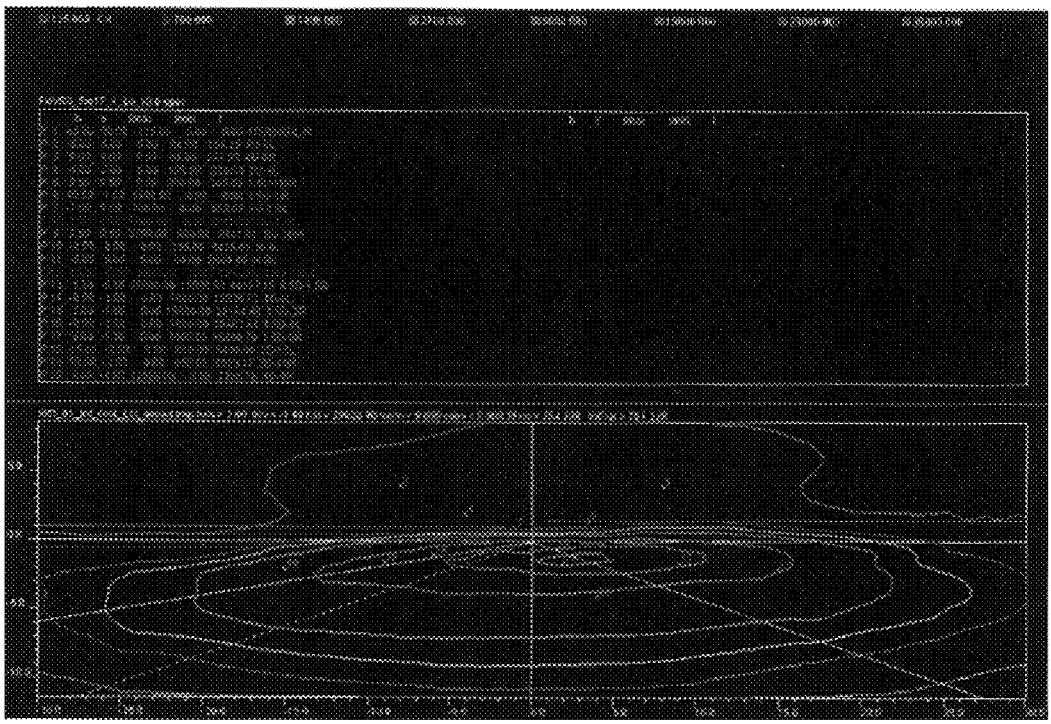
FIG. 8 is a representation of a beam pattern produced by the LED light source module according to the present invention.
Figure 9:
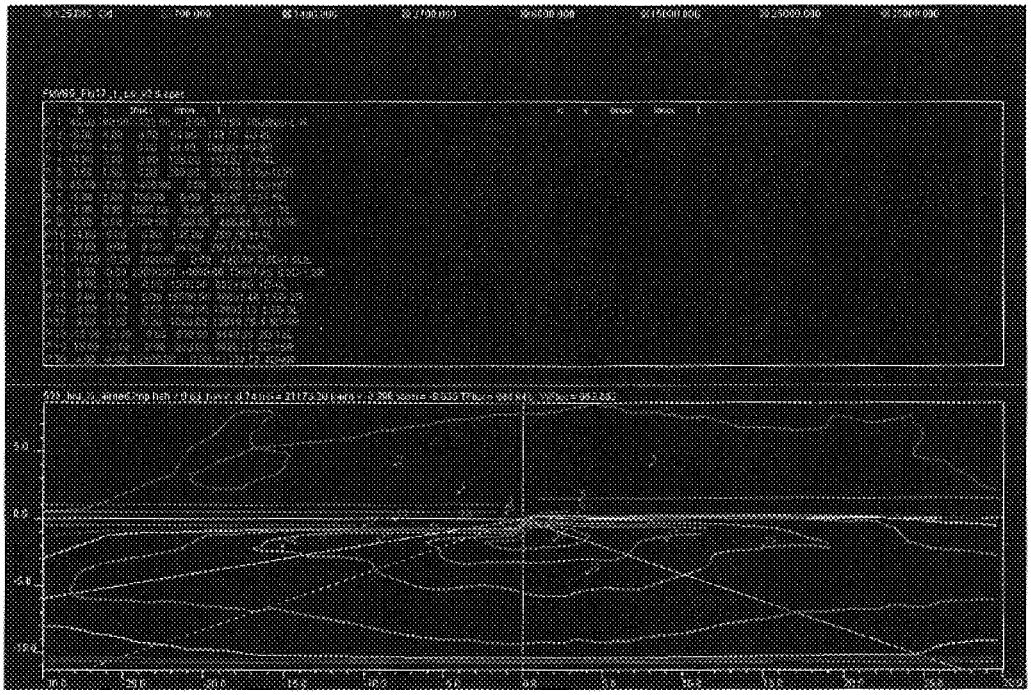
FIG. 9 is a representation of a beam pattern produced by the LED light source module according to the present invention.

Reflector 28 and lens 26 cooperate to overlap the illumination from the individual LED light source modules 22 to produce the beam patterns such as those shown in FIGS. 8 and 9.

Power for illumination of LED light source modules 20 may be provided by a low voltage power supply or 12 volt power supply which is conventionally available in vehicles.

Multiple LED modules for a desired function are arranged in an array so that LED modules dedicated to a particular function (such as high beam) are arranged to cooperate with adjacent like-function LED modules. Although any number of LED modules can be used for each function, a low-beam array preferably includes 5–25 LED modules with LED lights sources of at least 25 lumens each, preferably of at least 40 lumens and more preferably of at least 55 lumens each. An LED array dedicated to a low-beam function preferably includes about 10–18 individual LED modules. While Lumileds Luxeon LEDs are preferred, one of ordinary skill in the art would recognize that other types of LEDs may be available for use in the present invention. Although the LEDs may be any color, in the preferred embodiment the LEDs are white for use as vehicular high beam/low beam headlamps.

A preferred high-beam array includes from about 8 to about 30 LED light sources dedicated to that function of from about 25 lumens to about 100 lumens, and preferably at least 30 lumens each. Preferably, a high-beam LED module array includes from about 10 to about 18 modules. The number of LED modules dedicated to a high-beam function may be greater than, less than or equal to the number of modules dedicated to the low beam function.

Figure 7A:
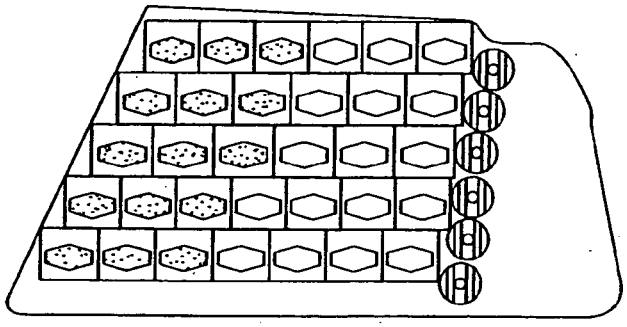
FIG. 7A is a front view of an embodiment of a vehicular headlamp configuration including an LED light source array according to the present invention.
Figure 7B:
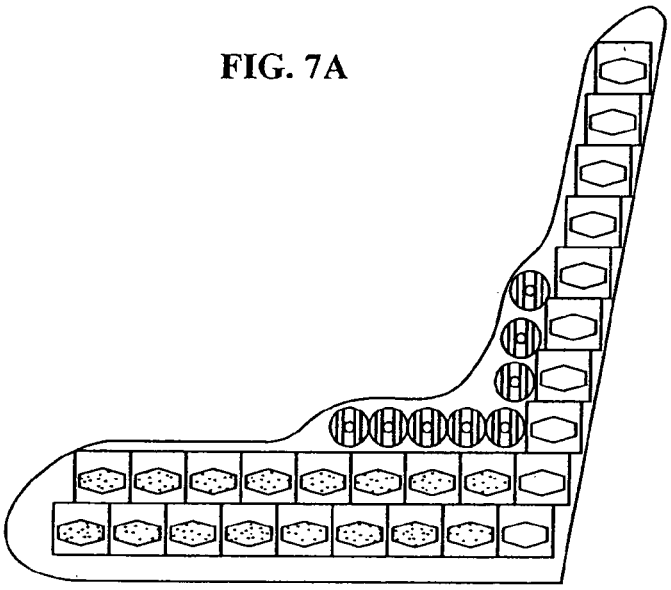
FIG. 7B is a front view of an embodiment of a vehicular headlamp configuration including an LED light source array according to the present invention.
Figure 7C:
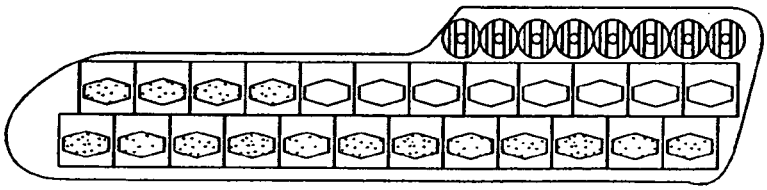
FIG. 7C is a front view of an embodiment of a vehicular headlamp configuration including an LED light source array according to the present invention.
Figure 7D:
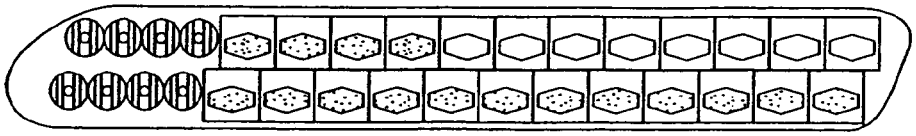
FIG. 7D is a front view of an embodiment of a vehicular headlamp configuration including an LED light source array according to the present invention.

Vehicular headlamps including LED arrays according to the present invention provide greater flexibility and diversity in the frontal configuration of the headlamp than conventional headlamps using halogen or HID bulbs as illustrated in FIGS. 7A–D. FIG. 7A shows frontal view of a stacked headlamp configuration. In FIG. 7A high beam LED light sources are arranged in columns and rows with adjacent low beam and turn signal LED light sources. FIG. 7B shows a frontal view of another headlamp configuration with an LED array of the present invention in which the high beam LED light source array comprises two horizontal rows, the low beam 10 LED light source array comprises a single vertical column adjacent to the high beam array and the turn signal array comprises a single row and a single column of LED light sources adjacent the high and low beam LED light sources. FIGS. 7C and 7D show additional headlamp configurations in which the high beam, low beam and turn signal LED light sources are arranged in vertically adjacent horizontal rows.

Of course, it should be understood that a wide range of changes and modifications can be made to the embodiments described above. It is therefore intended that the foregoing description illustrates rather than limits this invention, and that it is the following claims, including all equivalents, that define this invention.

What is claimed is:

1. A vehicular headlamp comprising:

an LED headlamp array comprising at least two discrete LED light source modules, and means for supplying electrical power to the LED light source array, wherein each module comprises, a white light emitting LED light source, a catadioptric lens for collecting and directing light from the LED light source, and a reflector having a multi-faceted internal reflecting surface configured to reflect light from both the LED light source and the catadioptric lens.

2. The LED headlamp array of claim 1 wherein the multi-faceted internal reflecting surface comprises a parabola having at least four reflecting surfaces.

3. The LED headlamp array of claim 2 wherein the internal reflecting surface comprises eight reflecting surfaces.

4. The LED headlamp array of claim 1 wherein the facets of the internal reflecting surface are contiguous and radially aligned with respect to the light source.

5. The LED headlamp array of claim 1 wherein each light source module may be selectively and differently controlled.

6. The LED headlamp array of claim 1 wherein the array comprises at least two arrays of LED light sources modules dedicated to distinct light source functions.

7. The LED headlamp array of claim 6 comprising a first light source array wherein the LED light source modules comprise a lens having both reflective and refractive optics, and a second LED light source array comprising LED light source modules having refractive optics.

8. The LED headlamp array of claim 7 wherein the refractive optics are selected from the group consisting of pillows and flutes.

9. The LED headlamp array of claim 7 wherein the first LED array comprises from about 8 to about 25 LED light source modules and the second LED array comprises from about 8 to about 30 LED light source modules.

10. The LED headlamp array of claim 9 wherein each LED light source module of the first LED array comprises an LED light source having an intensity of at least 25 lumens and each LED light source module of the second LED array comprises an LED light source having an intensity of at least 30 lumens.

11. A vehicular headlamp assembly comprising:

a housing, an LED light source array disposed with in the housing, having a first set of LED light source modules and second set of LED light source modules, wherein each module of the first set of LED light source modules comprises a white-light emitting LED light source and a lens having both reflective and refractive optics, and each module of the second set of LED light source modules comprises a white light emitting LED light source and a lens having only refractive optics;

and means for providing electrical power to the headlamp.

12. The vehicular headlamp assembly of claim 11 wherein the illumination and intensity of the first and second sets of light source modules are selectively controlled.

13. The headlamp of claim 11 wherein the modules of at least one of the LED light source arrays comprises a reflector having a faceted internal reflecting surface.

14. The headlamp of claim 13 wherein the faceted internal reflecting surface has an interior configuration selected from the group consisting of parabolas, ellipses, hyperbolas, cones and hemispheres.

15. The headlamp of claim 14 wherein the internal reflecting surface of the reflector comprises at least two contiguous radially aligned facets.

16. The headlamp of claim 15 wherein the internal reflecting surface of the reflector comprises two to eight contiguous radially aligned facets around the light source.

17. The headlamp of claim 16 wherein the internal reflecting surface of the reflector comprises a parabola.

18. The headlamp of claim 16, wherein the internal reflecting surface of the reflector comprises eight facets.

19. A vehicular headlamp comprising:

an LED headlamp array comprising at least two discrete LED light source modules, and means for supplying electrical power to the LED light source array, wherein each module comprises, means for emitting white light, a catadioptric means for collecting and directing light from the means for emitting white light, and means for reflecting light emitted from both the means for emitting white light and the catadioptric means.

20. An LED headlamp array of claim 19 further comprising means for selectively controlling illumination and intensity of the means for emitting white light.

21. A method of providing illumination from an automobile headlamp comprising:

providing an array of white light emitting light source modules disposed within a housing of the headlamp, wherein each module comprises a faceted reflector, an LED light source disposed within the reflector, and a catadioptric lens in substantial register with the LED light source disposed within the reflector;

providing electrical power to the light source array;

illuminating at least one of the light source modules of the light source array;

collecting and distributing light from the LED light source;

reflecting light from the LED light source; and emitting light from the headlamp.

* * * * *